US011774095B2

(12) United States Patent
Barber

(10) Patent No.: US 11,774,095 B2
(45) Date of Patent: Oct. 3, 2023

(54) MODULAR PYROPHORIC LIGHTER

(71) Applicant: ZIPPO MANUFACTURING COMPANY, Bradford, PA (US)

(72) Inventor: Brian J. Barber, Cyclone, PA (US)

(73) Assignee: ZIPPO MANUFACTURING COMPANY, Bradford, PA (US)

( * ) Notice: Subject to any disclaimer, the term of this patent is extended or adjusted under 35 U.S.C. 154(b) by 331 days.

(21) Appl. No.: 17/290,956

(22) PCT Filed: Nov. 15, 2019

(86) PCT No.: PCT/US2019/061583
§ 371 (c)(1),
(2) Date: May 3, 2021

(87) PCT Pub. No.: WO2020/106551
PCT Pub. Date: May 28, 2020

(65) Prior Publication Data

US 2021/0388986 A1 Dec. 16, 2021

Related U.S. Application Data

(60) Provisional application No. 62/769,794, filed on Nov. 20, 2018.

(51) Int. Cl.
*F23Q 2/06* (2006.01)
*F23Q 2/36* (2006.01)
(Continued)

(52) U.S. Cl.
CPC ..... *F23Q 2/06* (2013.01); *F23Q 2/36* (2013.01); *F23Q 2/42* (2013.01); *F23Q 2/48* (2013.01)

(58) Field of Classification Search
CPC ..... F23Q 2/42; F23Q 2/52; F23Q 2/06; F23Q 2/02; F23Q 2/08; F23Q 2/48; F23Q 1/06; F23Q 2/173; F23Q 2/36
See application file for complete search history.

(56) References Cited

U.S. PATENT DOCUMENTS 2,608,080 A 8/1952 Simon et al.
2,704,447 A * 3/1955 Flickinger ..... F23Q 2/46 431/151

(Continued)

FOREIGN PATENT DOCUMENTS

AU 695612 B 8/1998
EP 0722742 A2 7/1996

(Continued)

*Primary Examiner* — Alfred Basichas
(74) *Attorney, Agent, or Firm* — Hodgson Russ LLP

(57) ABSTRACT

A modular pyrophoric lighter includes an outer case, an insert removably received by the outer case, and a renewal module removably received by the insert. The renewal module quickly slides into the insert to provide a new fuel supply, wick, and flint. The renewal module quickly slides out of the insert when the fuel, wick, and/or flint is spent so that a new renewal module may be installed. In an alternative embodiment, a modular lighter includes an outer case, an insert removably received by the outer case, and a fuel module removably received by the insert. The fuel module quickly slides into the insert to provide a new fuel supply. The fuel module quickly slides out of the insert when the fuel is spent so that a new fuel module may be installed.

6 Claims, 10 Drawing Sheets

(51) Int. Cl.
*F23Q 2/42* (2006.01)
*F23Q 2/48* (2006.01)

(56) References Cited

U.S. PATENT DOCUMENTS

| | | | |
|---|---|---|---|
| 6,102,688 | A | 8/2000 | Mifune et al. |
| 6,726,470 | B1 | 4/2004 | Meister |
| 7,462,033 | B2 | 12/2008 | Xie |
| 2008/0131826 | A1 | 6/2008 | Xie |

FOREIGN PATENT DOCUMENTS

| | | |
|---|---|---|
| GB | 677303 | 8/1952 |
| GB | 837803 | 6/1960 |

* cited by examiner

MODULAR PYROPHORIC LIGHTER

FIELD OF THE INVENTION

The present invention relates to pyrophoric lighters having a flint frictionally engaged by a flint wheel for generating a spark to ignite fuel contained in a wick positioned near the flint.

BACKGROUND OF THE INVENTION

Traditional pyrophoric lighters (e.g. ZIPPO brand windproof lighters) have a hollow outer case with a hinged lid and a removable insert which slides into the outer case. The insert comprises a housing, a chimney atop the housing, a flint spring assembly acting on a flint, a friction wheel, cotton-like packing material saturated with lighter fuel, a wick extending from the packing material up into the chimney, and a felt pad for keeping the packing material within the housing. A bottom portion of the wick extends into the packing material such that the wick absorbs lighter fuel and conveys the lighter fuel to an exposed top portion of the wick arranged next to the flint. The flint is frictionally engaged by the friction wheel when a user rotates the wheel, thereby generating a spark to ignite fuel contained in the exposed portion of the wick. The fuel, flint, and wick are consumed over time and must be replaced to keep the lighter in working condition. Also, the packing material which holds the fuel will degrade over time and need replacement.

To renew the lighter, a technician or the user must remove the insert from the outer case, remove the felt pad and packing material from the insert housing, remove the old wick, unscrew and slide out the flint spring assembly from an internal tube of the housing, and remove the remaining piece of flint (if any) by gently tapping the insert on a hard surface or prying it out with a tool. The technician or user must then install a new wick and refuel the lighter by sliding the new wick up through the housing into the chimney or down through the chimney into the housing, bending the top portion of the new wick over the edge of the chimney, replacing the packing material or inserting new packing material bit by bit while bending the new wick in serpentine fashion through the packing material, adding fuel to the packing material, replacing the felt pad, and trimming off a top end of the wick so that the wick is level with the top edge of the chimney. The technician or user must install a new flint by placing the new flint on a pusher element of the flint spring assembly, sliding the flint spring assembly back into the internal tube within the housing, and tightening a base screw of the flint spring assembly. The insert may then be slid back into the outer case. As may be appreciated, renewing the lighter requires knowledge, effort, and skill.

Merely refueling the lighter, as opposed renewing the lighter, also requires knowledge, effort, and skill. To refuel the lighter, a technician or the user must remove the insert from the outer case, remove the felt pad at the base of the insert, saturate the packing material with lighter fluid, replace the felt pad to cover the packing material, and slide the insert back into the outer case. If the user or technician overfills the packing material with lighter fluid or mishandles the lighter fluid, some of the lighter fluid may come into contact with skin and cause irritation.

SUMMARY OF THE INVENTION

The present disclosure provides a modular lighter which may be safely renewed or refueled with minimal knowledge, effort, and skill.

In one embodiment a modular lighter includes an outer case, an insert removably received by the outer case, and a renewal module removably received by the insert. The renewal module quickly slides into the insert to provide a new fuel supply, wick, and flint. The renewal module quickly slides out of the insert when the fuel, wick, and/or flint is spent so that a new renewal module may be installed.

In another embodiment, a modular lighter includes an outer case, an insert removably received by the outer case, and a fuel module removably received by the insert. The fuel module quickly slides into the insert to provide a new fuel supply. The fuel module quickly slides out of the insert when the fuel is spent so that a new fuel module may be installed.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
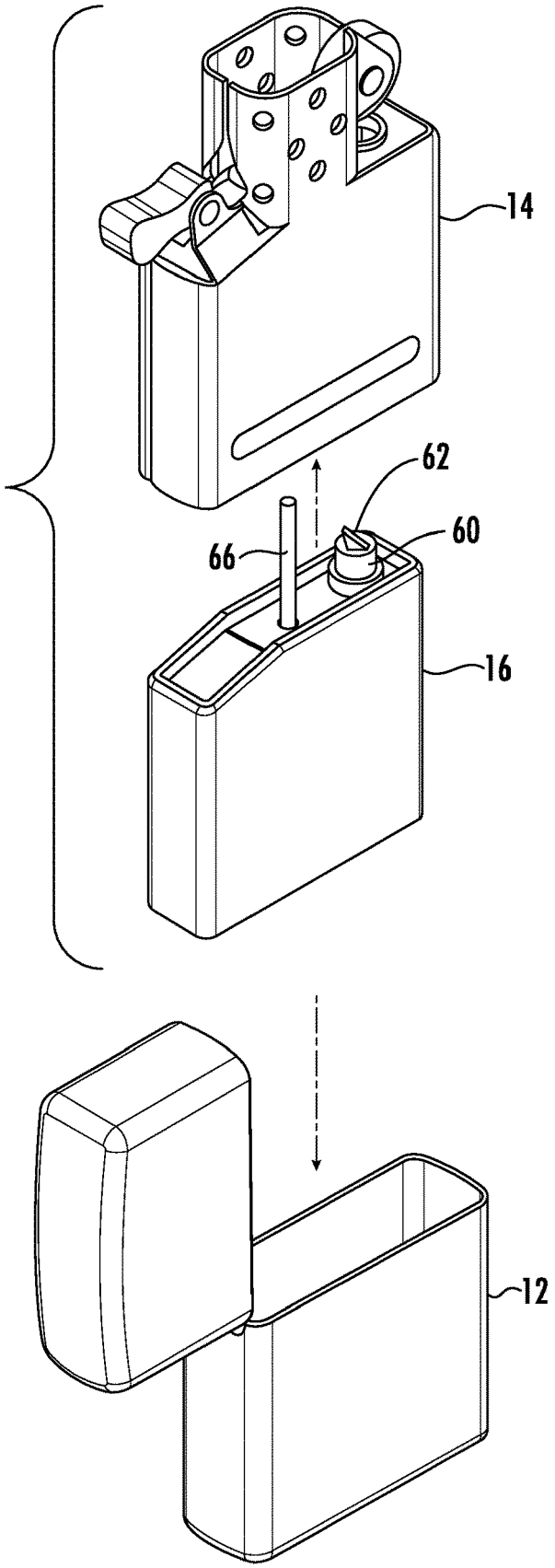
FIG. 1 is an exploded isometric view of a modular lighter formed in accordance with a first embodiment of the present invention.
Figure 2:
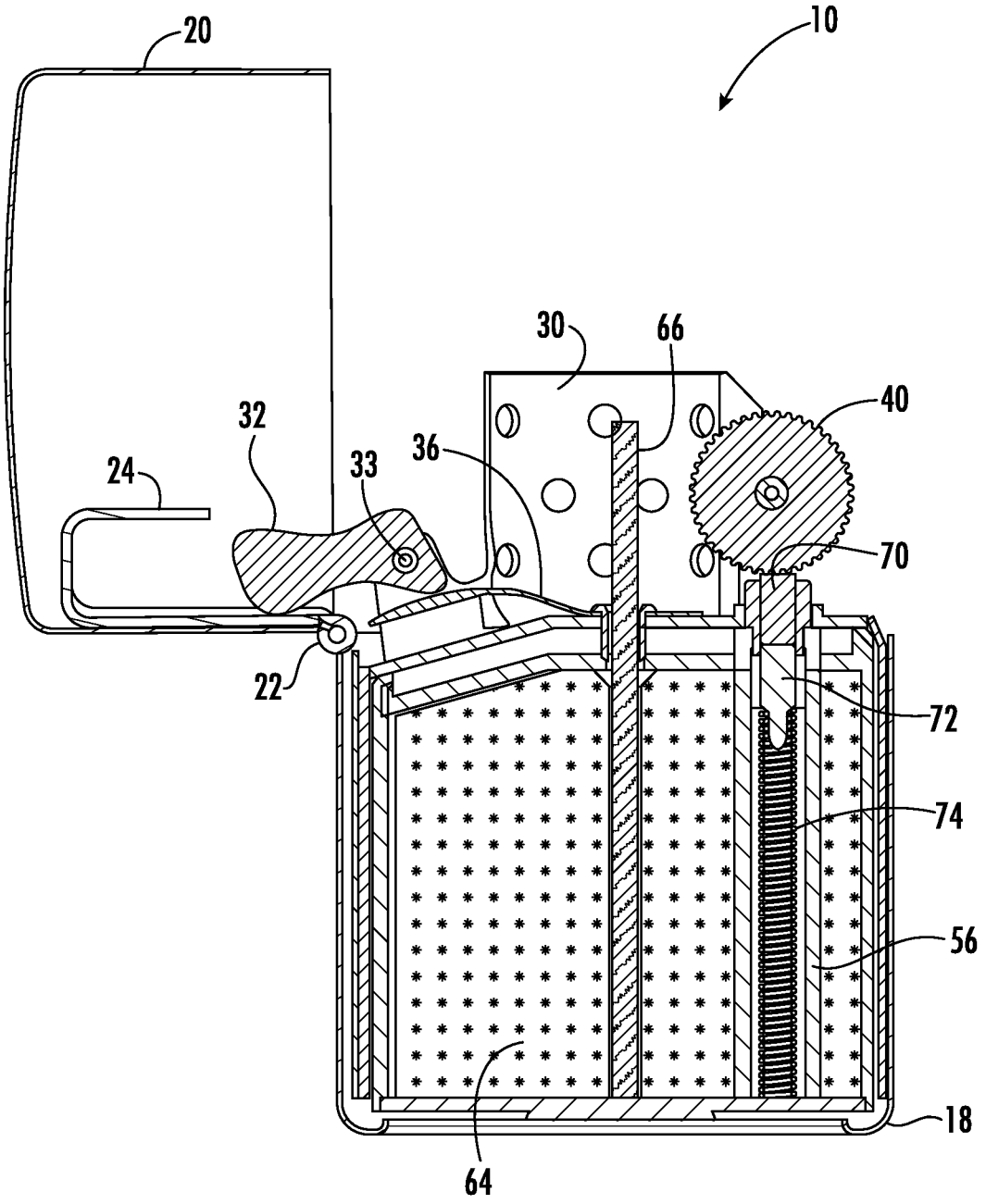
FIG. 2 is a cross-sectional view of the modular lighter shown in FIG. 1.

FIGS. 1 and 2 show a modular lighter 10 formed in accordance with a first embodiment of the present invention. Lighter 10 may generally comprise an outer case 12, an insert 14, and a renewal module 16.

Outer case 12 may include a lower casing 18, a cover 20 connected to lower casing 18 by a hinge 22, and a hook member 24 fixed to internal wall surfaces of lower casing 18 and cover 20.

Figure 5:
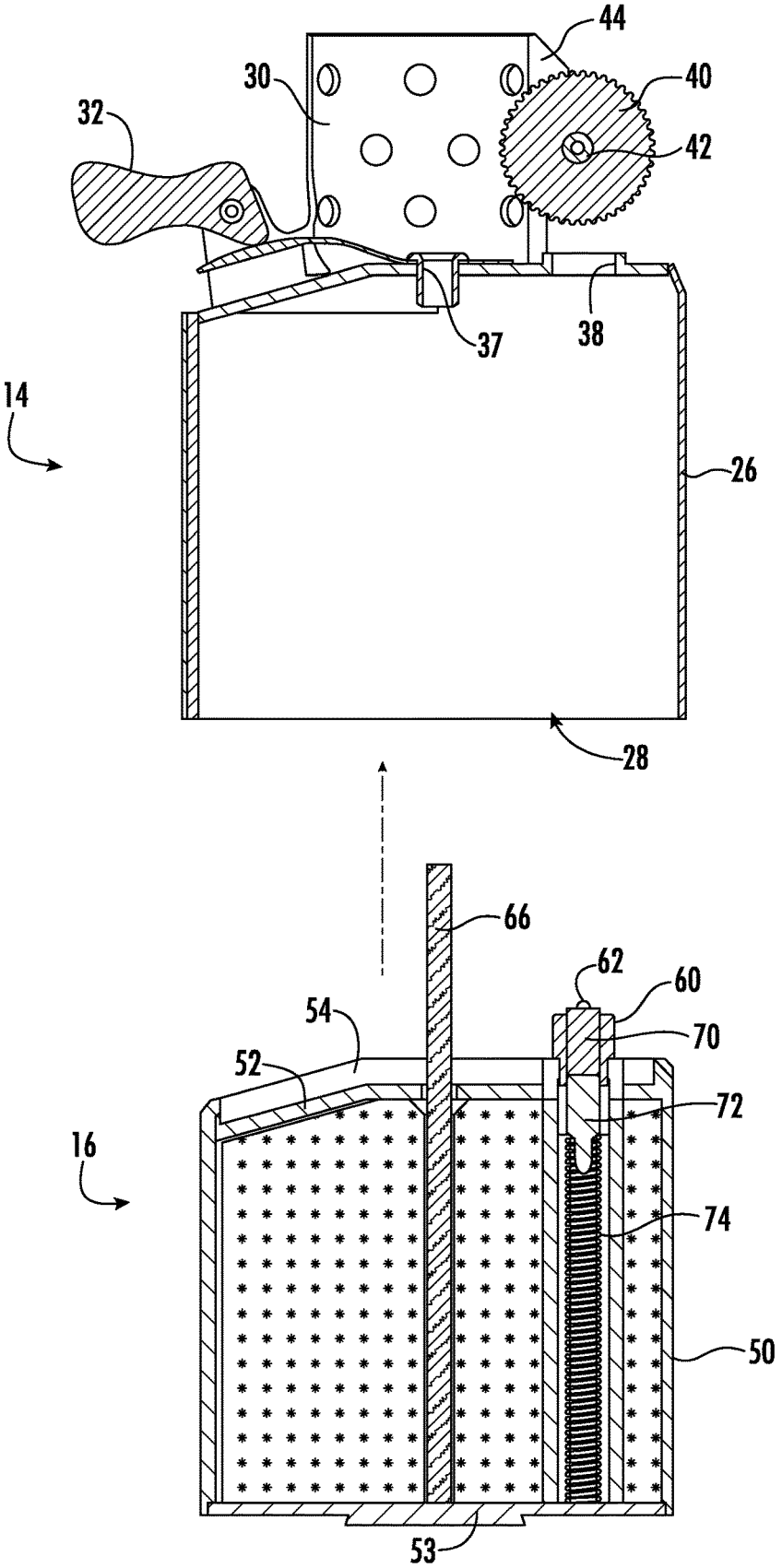
FIG. 5 is an exploded cross-sectional view of the renewal module and the insert of the modular lighter, wherein the renewal module is shown in its unpackaged condition ready for installation into the insert.

Insert 14, shown apart from other structure in FIG. 5, may include a housing 26 open at a bottom end 28, a chimney 30 extending upward from a top wall of housing 26, a cover latch 32 pivotally mounted on a latch base 34 adjacent to chimney 30 for rotation about a pivot axis defined by a pivot pin 33, and a leaf spring 36 fastened to the top wall of housing 26, wherein the leaf spring biases latch 32 in a rotational direction about the axis of pivot pin 33. Insert 14 may further include a wick aperture 37 and a flint aperture 38 through the top wall of housing 26, and a friction wheel 40 positioned above flint aperture 38 and rotatably mounted on an axle 42 supported by ears 44 extending from a side of chimney 30.

Figure 3:
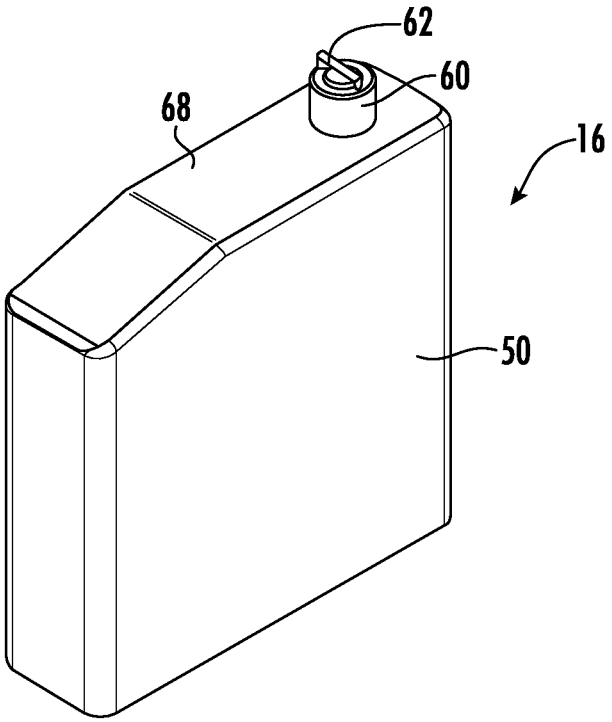
FIG. 3 is an isometric view of a renewal module of the modular lighter shown in FIGS. 1 and 2, wherein the renewal module is shown in its packaged condition prior to installation of the renewal module into an insert of the modular lighter.
Figure 4:
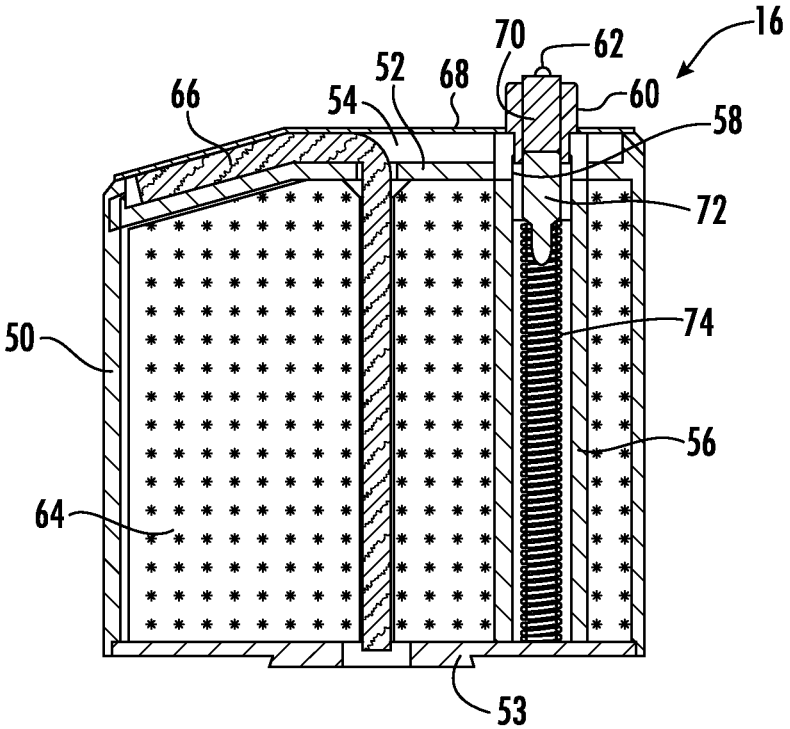
FIG. 4 is a cross-sectional view of the renewal module shown in FIG. 3.

An example of renewal module 16 in its unused (i.e. packaged) condition will now be described with reference to FIGS. 3 and 4. Renewal module 16 may include an enclosure 50 having a slightly sunken upper wall 52 defining an external recess 54 above upper wall 52. Enclosure 50 may also have an internal hollow tube 56 extending vertically through the enclosure and communicating with a flint opening 58. A cylindrical flint cap 60 may extend upward from upper wall 52 around flint opening 58, and a sacrificial flint retention member 62 (see also FIG. 7) may be provided over a top end of flint cap 60.

Renewal module 16 may further include a porous body 64 received within enclosure 50 for holding lighter fuel, and a wick 66 having a bottom portion extending into porous body 64 and a top portion extending through a hole in upper wall 52 and into recess 54. Porous body 64 may be produced from natural or synthetic cellulose fiber, from a thermoplastic polymer, or from another suitable material. A fluid-sealing sheet 68, for example a foil sealing material, may be removably adhered to the top of enclosure 50 to cover recess 54 and prevent evaporation of fuel from renewal module 16 before the renewal module is placed into use.

Renewal module 16 may further include a flint 70 positioned atop a pusher 72, which in turn is biased in an upward direction by a spring 74. An opposite end of spring 74 may engage a base wall 53 of enclosure 50. Pusher 72 and spring 74 may be contained by internal hollow tube 56 of enclosure 50, such that upward force is applied to flint 70 but flint 70 is retained by abutment against flint retention member 62.

Figure 6:
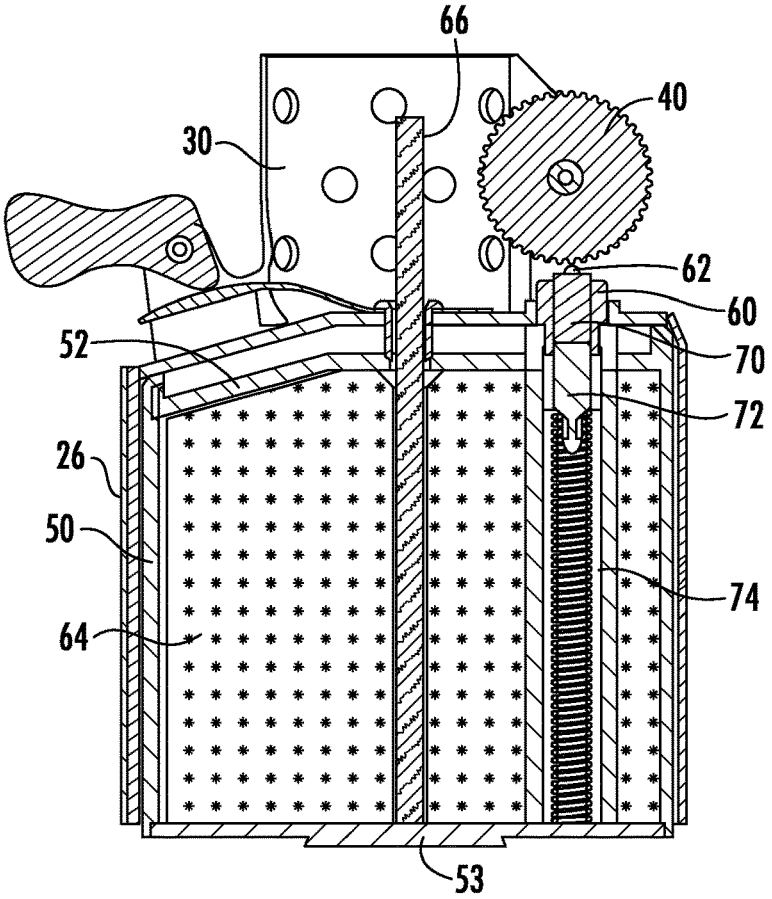
FIG. 6 is a cross-sectional view of the lighter insert with the renewal module installed therein.
Figure 7:
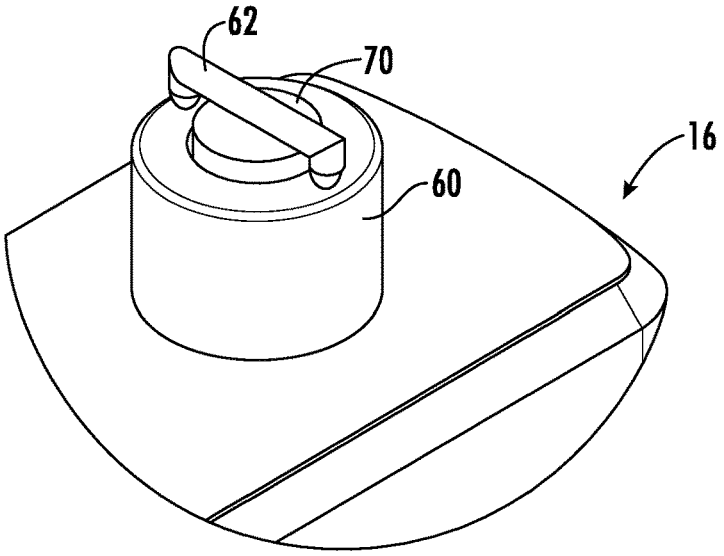
FIG. 7 is an enlarged detailed view showing a flint cap and flint retention member of the renewal module.

A method of renewing lighter 10 by installing a renewal module 16 will now be described with reference also to FIGS. 5-7. Insert 14 may be removed from outer case 12 and a spent renewal module, if any, may be removed from insert 14 by pulling the spent renewal module out through the open bottom end 28 of insert 26. A new renewal module 16 may be prepared for installation by peeling off sealing sheet 68 from the top of enclosure 50 to expose the wick 66, and straightening wick 66 to extend vertically from the renewal module 16 as shown in FIG. 5. Renewal module 16 may then be installed into insert 14 by sliding the renewal module upward into insert housing 26 through open bottom end 28 such that the tip of wick 66 proceeds through wick aperture 37 and into chimney 30 and flint cap 60 proceeds through flint aperture 38. Renewal module 16 may be slightly compressed when received by insert housing 26 such that renewal module 16 is retained in housing 26 by friction. When renewal module 16 is fully installed in insert 14, as shown in FIG. 6, flint retention member 62 is engaged by friction wheel 40. Insert 14 may then be returned into outer case 12. To complete the renewal method, the user may rotate friction wheel 40 until flint retention member 62 is broken away, thereby allowing spring 74 to force pusher 72 upward to bring flint 70 into contact with friction wheel 40. Subsequent operation of friction wheel 40 will then generate a spark for igniting lighter fluid contained in wick 66.

Figure 8:
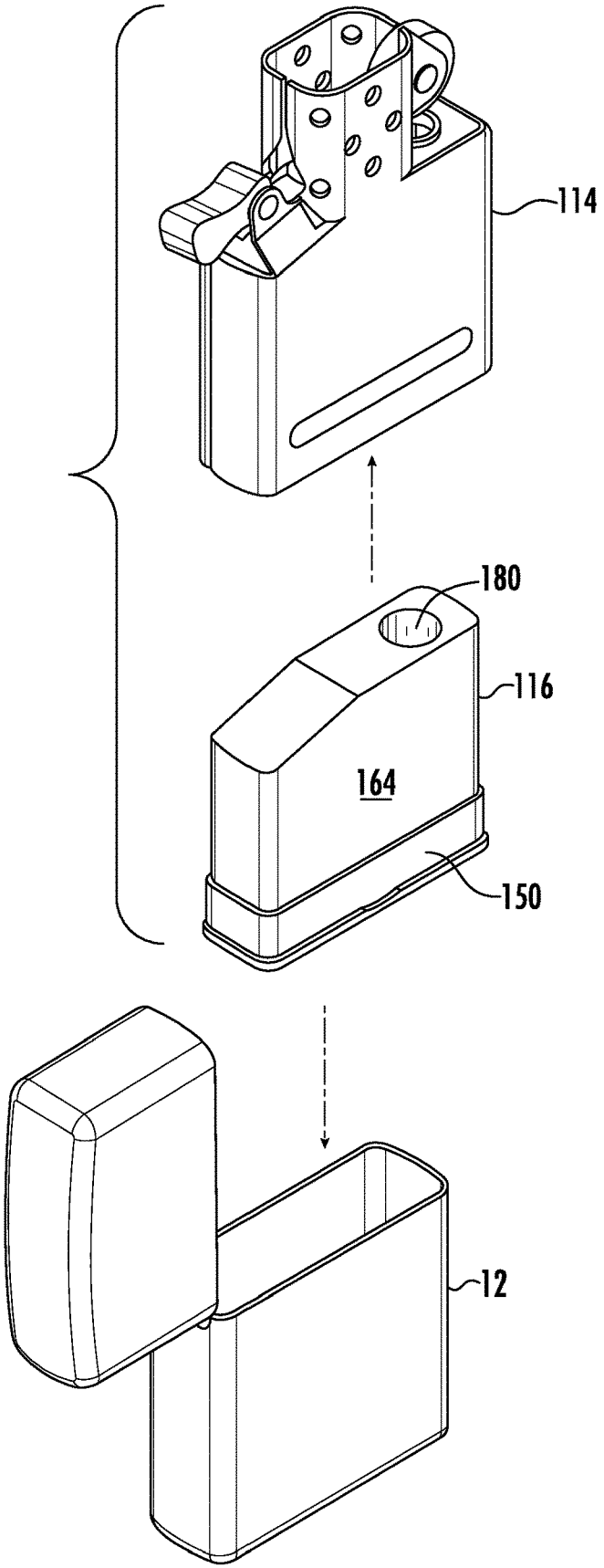
FIG. 8 an exploded isometric view of a modular lighter formed in accordance with a second embodiment of the present invention.
Figure 9:
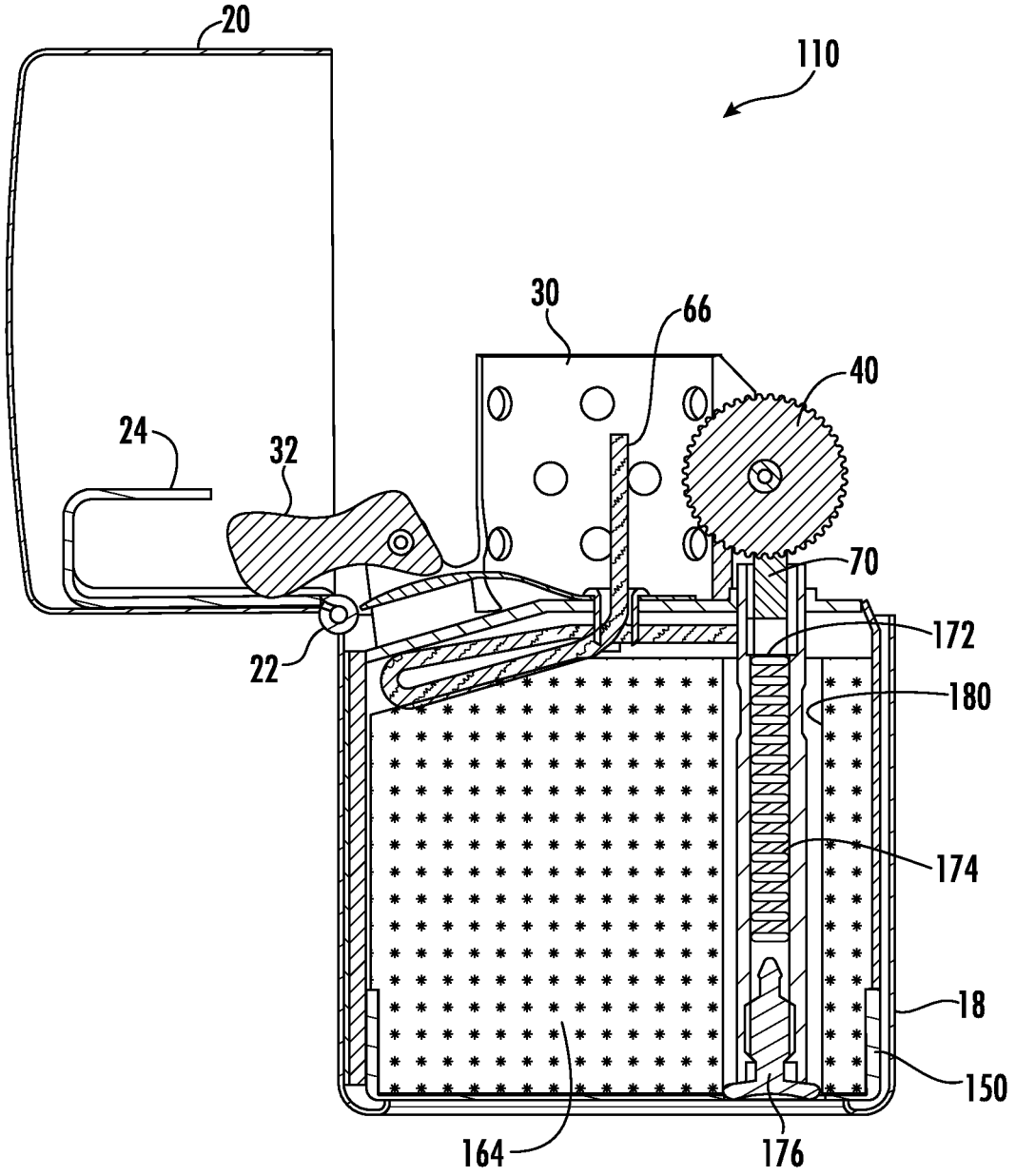
FIG. 9 is a cross-sectional view of the modular lighter shown in FIG. 8.
Figure 10:
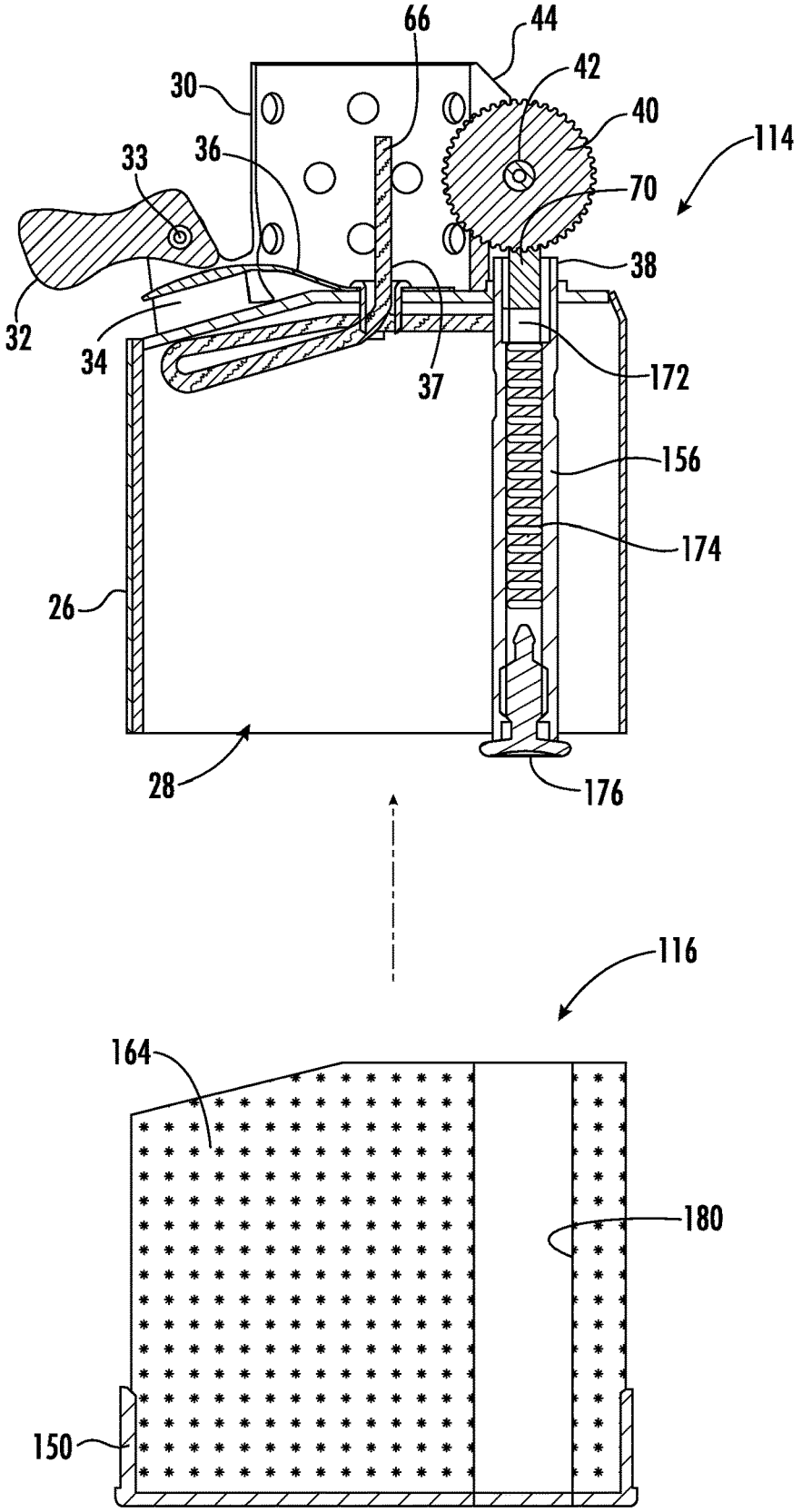
FIG. 10 is an exploded cross-sectional view of a fuel module and an insert of the modular lighter shown in FIG. 8.

A modular lighter 110 formed in accordance with a second embodiment of the present invention will now be described with reference to FIGS. 8-10. Lighter 110 may generally comprise outer case 12, an insert 114, and a fuel module 116. Lighter 110 differs from lighter 10 of the first embodiment in that fuel module 116 provides fuel without a new wick or a new flint, whereas renewal module 16 of the first embodiment provides fuel, a new wick, and a new flint.

Insert 114 is similar to insert 14 of the first embodiment to the extent that insert 114 may include a housing 26 open at a bottom end 28, a chimney 30 extending upward from a top wall of housing 26, a cover latch 32 pivotally mounted on a latch base 34 adjacent to chimney 30 for rotation about a pivot axis defined by a pivot pin 33, and a leaf spring 36 fastened to the top wall of housing 26 for biasing latch 32 in a rotational direction about the axis of pivot pin 33. Insert 114 may further include a wick aperture 37 and a flint aperture 38 through the top wall of housing 26, and a friction wheel 40 positioned above flint aperture 38 and rotatably mounted on an axle 42 supported by ears 44 extending from a side of chimney 30. Insert 114 differs from insert 14 of the first embodiment in that insert 114 may further include a wick 66 extending from within housing 26 through wick aperture 37 and into chimney 30, an internal hollow tube 156 extending vertically through housing 26 and communicating with flint aperture 38, and a flint spring assembly within hollow tube 156. The flint spring assembly may have a flint pusher 172 on which a flint 70 may be positioned, a base screw 176 threadably mating with tube 156, and a spring 174 having one end engaging flint pusher 172 and an opposite end engaging base screw 176.

Fuel module 116 may include a porous body 164 and an enclosure 150 surrounding at least a lower portion of porous body 164. Similar to porous body 64 of the first embodiment, porous body 164 holds lighter fuel and may be produced from natural or synthetic cellulose fiber, from a thermoplastic polymer, or from another suitable material. Enclosure 150 may be made of a fluid-tight material, and fuel module 116 may be packaged in a fluid sealed packaging (not shown) prior to use to prevent evaporation of the fuel in porous body 164. Porous body 164 includes a passage 180 extending vertically through porous body 164 and arranged to receive internal hollow tube 156 of insert 114 when fuel module 116 is installed into insert 114.

Figure 11:
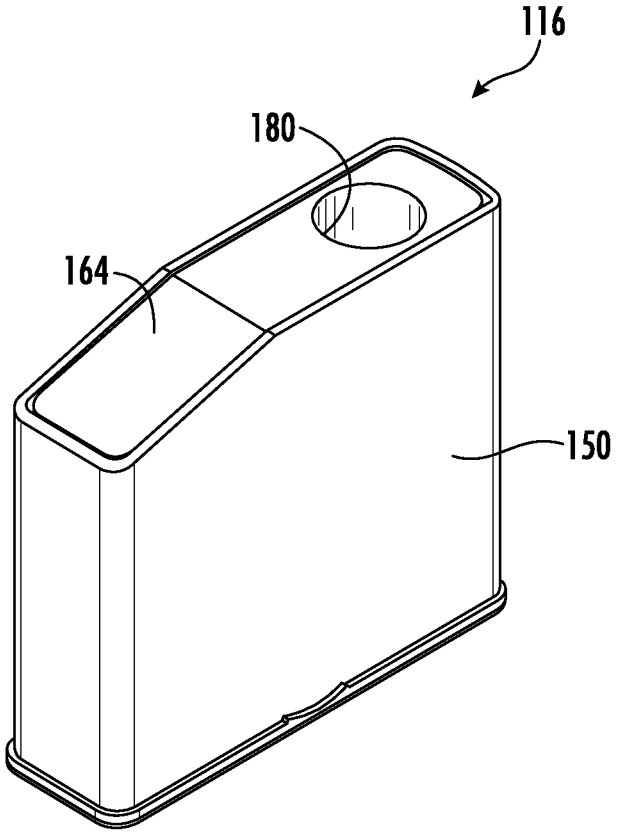
FIG. 11 is an isometric view of a fuel module of the modular lighter according to a variation of the second embodiment.
Figure 12:
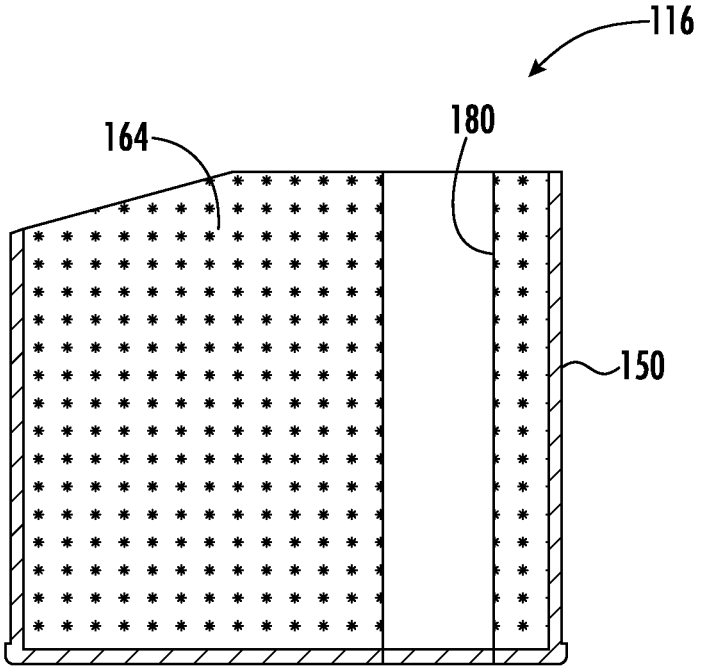
FIG. 12 is a cross-sectional view of the fuel module shown in FIG. 11.

FIGS. 11 and 12 illustrate a variation of fuel module 116, wherein sidewalls of enclosure 150 extend all the way up to a top surface of porous body 164 such that a bottom surface and all side surfaces of porous body 164 are completely covered by enclosure 150, and only the top surface of porous body 164 is left uncovered. In the variation of FIGS. 11 and 12, packaging may be reduced to a removable fluid-sealing sheet (not shown) adhered to the top edges of enclosure 150.

Figure 13:
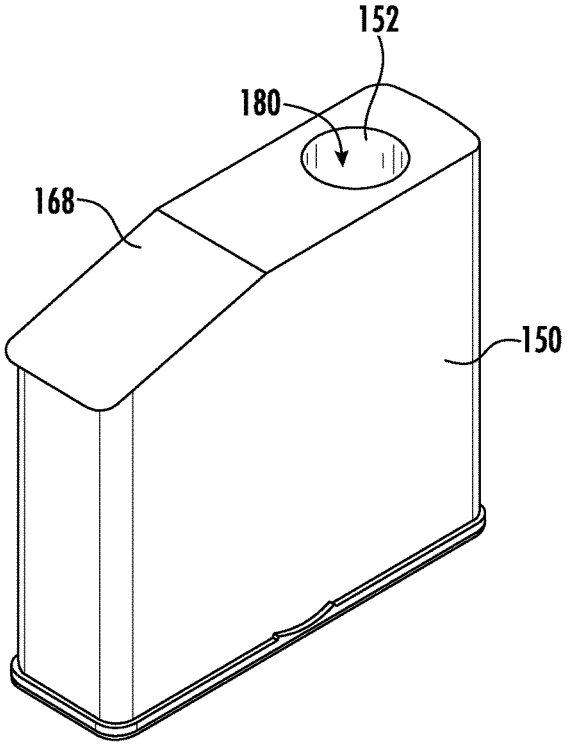
FIG. 13 is an isometric view of a fuel module of the modular lighter according to another variation of the second embodiment.
Figure 14:
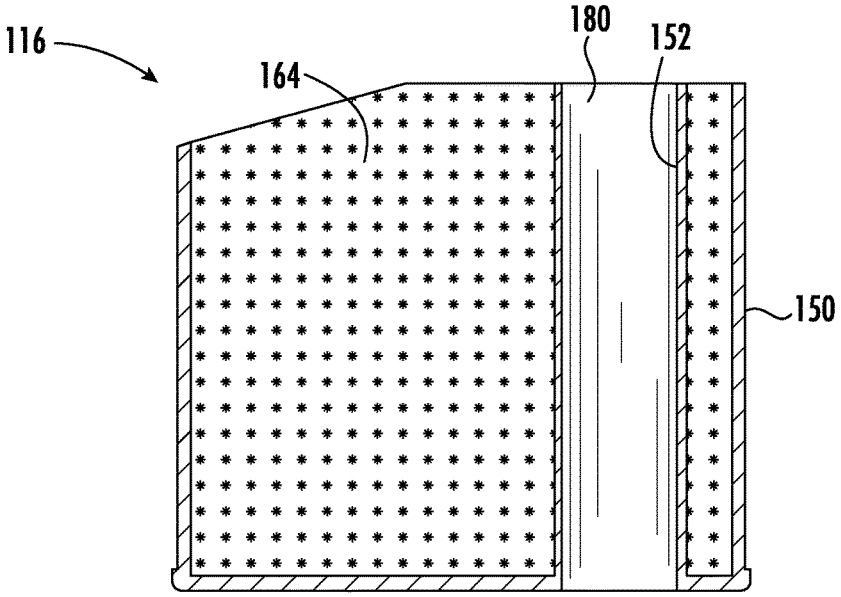
FIG. 14 is a cross-sectional view of the fuel module shown in FIG. 13, with a sealing cover of the fuel module removed.

FIGS. 13 and 14 show another variation of fuel module 116 similar to the variation shown in FIGS. 11 and 12, wherein a tubular wall 152 of fluid-tight material extends upward from enclosure 150, thereby defining a cylindrical passage 180 for receiving tube 156 of insert 114 when fuel module 116 is installed into insert 114. In FIG. 13, a removable fluid-sealing cover 168 is shown for preventing evaporation of lighter fluid from porous body 164 through the open top of enclosure 150. Cover 168 may be attached by adhesive to enclosure 150 by adhesive, and may be removed from enclosure 150 just prior to installing fuel module 116 into insert 114 so that wick 66 of insert 114 can make contact with porous body 164.

A method of fueling or refueling lighter 110 by installing a new fuel module 116 will now be described. Insert 114 may be removed from outer case 12 and an empty fuel module, if any, may be removed from insert 114 by pulling the empty fuel module out through the open bottom 28 of insert 114. A new fuel module 116 may be prepared for installation by removing the new fuel module from its sealed packaging or by removing a sealing cover 168 from enclosure 150. Insert 114 may be prepared for receiving fuel module 116 by folding the bottom portion of wick 66 up against the top wall of housing 26 as shown in FIG. 10. Fuel module 116 may then be installed into insert 114 by sliding the fuel module upward into insert housing 26 through open bottom end 28 such that tube 156 of insert 114 slides into passage 180. Fuel module 116 may be slightly compressed when received by insert housing 26 such that fuel module 116 is retained in housing 26 by friction. Insert 114 may then be returned into outer case 12 to complete the fueling or refueling task.

Lighter 110 according to the second embodiment makes use of the current insert structure of ZIPPO brand windproof lighters, except that the felt pad and cotton-like packing material mentioned above are removed from the insert housing.

As will be appreciated, the present disclosure provides a modular lighter and associated method whereby the task of renewing the lighter with new fuel, a new wick, and a new flint is greatly simplified and expedited. The present disclosure also provides a modular lighter and associated method whereby the task of fueling or refueling the lighter is facilitated and expedited, and the risk of skin exposure to lighter fluid is reduced.

While the invention has been described in connection with exemplary embodiments, the detailed description is not intended to limit the scope of the invention to the particular forms set forth. The invention is intended to cover such alternatives, modifications and equivalents of the described embodiment as may be apparent to one of ordinary skill in the art.

What is claimed is:

1. A renewal module (16) for a modular lighter (10), the renewal module (16) comprising:

an enclosure (50) defining an external recess (54) and an internal hollow tube (56), the internal hollow tube (56) communicating with a flint opening (58) in the enclosure (50);

a porous body (64) received by the enclosure (50) for holding lighter fuel;

a wick (66) having a bottom portion in contact with the porous body (64) and a top portion extending through a hole in the enclosure (50) and into the external recess (54) of the enclosure (50);

a flint pusher (72) slidable within the internal hollow tube (56);

a spring (74) arranged within the internal hollow tube (56) for biasing the flint pusher (72) to slide in an upward direction; and a flint (70) supported by the flint pusher (72) and arranged to extend through the flint opening (58).

2. The renewal module (16) according to claim 1, further comprising a fluid-sealing sheet (68) removably adhered to the enclosure (50) to cover the external recess (54) and prevent evaporation of fuel from the renewal module (16) before the renewal module (16) is placed into use.

3. The renewal module (16) according to claim 1, further comprising a sacrificial flint retention member (62) arranged overtop the flint (70) to retain the flint (70) against the biasing force of the spring (74) before the renewal module (16) is placed into use.

4. The renewal module (16) according to claim 1, wherein the renewal module (16) is without a chimney for receiving the top portion of the wick (66) and the renewal module (16) is without a friction wheel (40) for contacting the flint (70) to generate a spark.

5. A pyrophoric lighter comprising:

an outer case (12);

an insert (14, 114) removably received by the outer case, the insert (14, 114) including a chimney (30) and a friction wheel (40);

a module (16, 116) removably received by the insert (14), the module (16, 116) including an enclosure (50, 150) and a porous body (64, 164) received by the enclosure (50, 150) for holding lighter fuel;

a wick (66) having a bottom portion in contact with the porous body (64, 164) and a top portion extending into the chimney (30); and a flint (70) spring-biased toward engagement with the friction wheel (40);

wherein the wick (66) is part of the module (16), the insert (14) includes a housing (26) having a wick aperture (37), and the wick (66) extends through the wick aperture (37) into the chimney (30) when the module (16) is received by the insert (14).

6. The pyrophoric lighter according to claim 5, wherein the flint (70) is part of the module (16), and the module (16) includes a pusher (72) on which the flint (70) is positioned and a spring (74) acting on the pusher (72), wherein the spring (74) is arranged to bias the flint (70) toward engagement with the friction wheel (40).

* * * * *